US008459538B2

(12) United States Patent
Raeth et al.

(10) Patent No.: US 8,459,538 B2
(45) Date of Patent: Jun. 11, 2013

(54) CORRUGATED BOX WITH AN IMPROVED OPENING SYSTEM

(75) Inventors: Erika J. Raeth, Germantown, TN (US); Kenneth Vilag, Lakeland, TN (US); Thomas J. Wood, Lakeland, TN (US)

(73) Assignee: Federal Express Corporation, Memphis, TN (US)

( * ) Notice: Subject to any disclaimer, the term of this patent is extended or adjusted under 35 U.S.C. 154(b) by 637 days.

(21) Appl. No.: 12/654,105

(22) Filed: Dec. 10, 2009

(65) Prior Publication Data

US 2011/0139865 A1 Jun. 16, 2011

(51) Int. Cl.
*B65D 17/00* (2006.01)

(52) U.S. Cl.
USPC ..... 229/222; 229/160.2; 229/237

(58) Field of Classification Search
USPC ..... 229/160.2, 222, 237, 241, 243, 244
See application file for complete search history.

(56) References Cited

U.S. PATENT DOCUMENTS

| | | | | | |
|---|---|---|---|---|---|
| 1,985,590 | A * | 12/1934 | Weiss | ..... | 229/222 |
| 2,970,743 | A * | 2/1961 | Joseph et al. | ..... | 229/244 |
| 3,366,311 | A * | 1/1968 | Simpson et al. | ..... | 229/222 |
| 3,865,322 | A * | 2/1975 | Hennessey | ..... | 229/222 |
| 3,885,732 | A * | 5/1975 | Foster | ..... | 229/222 |
| 5,549,243 | A * | 8/1996 | Dorier et al. | ..... | 229/244 |
| 6,669,083 | B2 * | 12/2003 | Bates | ..... | 229/237 |
| 7,000,824 | B2 * | 2/2006 | Saulas | ..... | 229/243 |

FOREIGN PATENT DOCUMENTS

FR 1471277 3/1967

OTHER PUBLICATIONS

PCT International Search Report and PCT Written Opinion from the International Searching Authority for corresponding PCT application PCT/US2010/058918 mailed Mar. 28, 2011 (13 pages total).

* cited by examiner

*Primary Examiner* — Gary Elkins
(74) *Attorney, Agent, or Firm* — Finnegan, Henderson, Farabow, Garrett & Dunner, LLP

(57) ABSTRACT

An opening system for a container includes an end flap for extending over an opening of the container, and a sealing flap overlying the end flap. The end flap includes an open area and the sealing flap includes a perforation pattern. The perforation pattern includes a first perforation line including a central section extending over the open area, and a second perforation line extending from the first perforation line to one edge of the sealing flap. The first perforation line is configured to tear at a lower force than the second perforation line.

30 Claims, 9 Drawing Sheets

CORRUGATED BOX WITH AN IMPROVED OPENING SYSTEM

FIELD OF THE INVENTION

The present invention relates to a cardboard box and more particularly to an improved system for easily opening the box.

BACKGROUND OF THE INVENTION

Cardboard boxes (containers) of different sizes are used widely to ship products. One type of cardboard box used for shipping is a corrugated fiberboard box. Among its many uses, corrugated boxes may be used by manufacturers of products to ship products to retail distributors or end users, and used by the general public to ship gifts and other items to friends and relatives. The users of these corrugated boxes prefer a container that can securely hold goods during shipment and which can be easily and neatly opened by the receiving party. In addition to these desirable features, the manufactures and purchasers of corrugated boxes prefer a box with an opening system that can be cheaply and reliably fabricated. Typically, the manufacturers of corrugated boxes incorporate opening systems or mechanisms into the boxes during their manufacture. Examples of commonly used opening systems include perforation zip strips, reinforced tear strips, stitched-in rip cord, and so forth.

Zip strips includes a strip of the container material substantially separated from the remainder of the container material by a plurality of generally parallel perforation lines, slits or other openings. These openings are positioned on either side of the strip such that removal of the strip opens the container. Typically, one end of the strip includes a tab or other feature that is configured to be grasped and pulled by a user. Pulling the tab tears the strip along the generally parallel openings on either side to separate the strip from the remainder of the box.

Reinforced tear strip includes a pair of spaced tear bands, formed of relatively non-tearable material, secured in parallel relation to the inside surface of the container side wall, along the entire length of the wall portion to be opened. A pair of spaced-apart guide strip elements, also arranged in parallel, may be provided on the outside surface of the container. The guide strips define between them a relatively wide section of container wall, which forms the tear strip portion. A reinforced grip portion attached to the tear bands is provided at one end of the wall. Pulling the grip portion causes the wide strip-like section of the wall to be torn away to open the box.

An opening system with a rip cord uses two strings which are stitched or sewn together through the layers of the corrugated material that forms the box. The rip cord severs the box into two sections as the stitching is pulled from the container.

These commonly used opening systems often break or tear during opening, resulting in the box being partially opened and requiring additional effort to complete the opening. Additionally, some of these systems may be expensive to manufacture. Thus, a need exists for an improved system for opening a cardboard box that overcomes the problems of known systems.

SUMMARY OF THE INVENTION

The present disclosure satisfies this need through the use of a combination of perforations and features in the sealing flaps and end flaps to provide a simple, easy, and reliable opening mechanism for the box.

In one aspect, an opening system for a container is disclosed. The opening system includes an end flap for extending over an opening of the container. The end flap includes an open area defined therein. The opening system also includes a sealing flap overlying the end flap. The sealing flap includes a perforation pattern. The perforation pattern includes a first perforation line including a central section extending over the open area, and a second perforation line extending from the first perforation line to one edge of the sealing flap. The first perforation line is configured to tear at a lower force than the second perforation line.

In another aspect, a method of opening a container is disclosed. The container includes a sealing flap that is integral with one face panel of the container overlaid on an end flap that is integral with an opposite face panel of the container. The end flap is adhered to the sealing flap at one edge and includes an open area defined therein. The sealing flap includes a perforation pattern having a first perforation line and a second perforation line extending from the first perforation line to a first edge of the sealing flap. The first perforation line is configured to tear at a lower force than the second perforation line and includes a central section that extends over the open area of the end flap. The sealing flap also including a fold line spaced apart from the central section. The method of opening includes pressing inwards on an area of a sealing flap between the central section of the first perforation line and the fold line to tear a region of the sealing flap at the first perforation line. The method also includes folding the torn region of the sealing flap at the fold line over an underside of the end flap proximate the open area, and pulling outwards on the underside of the end flap to tear the second perforation line and open a side of the container.

In a further aspect, a container is discloses. The container includes a first face panel spaced apart from a second face panel. The two face panels are interconnected by side walls to define a space between the two face panels. The container also includes an end flap integral with the first face panel and configured to be folded towards the second face panel to at least partially cover a gap between the two face panels. The end flap includes a open area defined therein. The container also includes a sealing flap integral with the second face panel and configured to be folded over the end flap when the end flap is folded. The sealing flap includes a perforation pattern. The perforation pattern includes a first perforation line extending at least partially over the open area of the end flap and a second perforation line extending from the first perforation line to an edge of the sealing flap. The second perforation line is configured to tear at a higher force than the first perforation line. The perforation pattern also includes a fold line spaced apart from a central section of the first perforation line such that an area of the sealing flap between the central section and the fold line is positioned over the open area of the end flap.

BRIEF DESCRIPTION OF THE DRAWINGS

The accompanying drawings, which are incorporated in and constitute a part of this specification, illustrate embodiments of the invention, which together with the description, serve to explain the principles of the invention.

DESCRIPTION OF THE EMBODIMENTS

Figure 1:
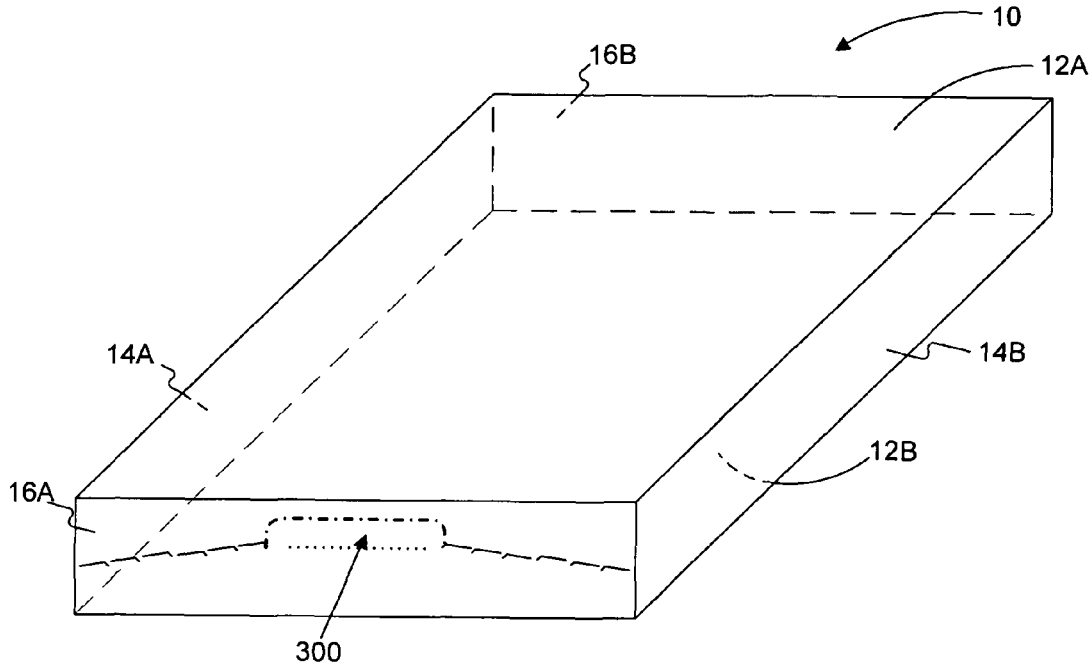
FIG. 1 is a perspective view of one exemplary embodiment of a corrugated fiberboard container including an embodiment of the disclosed opening mechanism.

The current disclosure describes embodiments of an opening system for a container, such as, but not limited to a fiberboard cardboard container. In the description that follows, the container is described as a corrugated fiberboard shipping container. However, the opening system can be incorporated in any type of container without limitation. Referring now to the drawings, FIG. 1 illustrates a shipping container 10. Container 10 includes four side panels interconnecting a first face panel 12A and opposing second face panel 12B. A pair of opposing side panels of container 10 form side walls 14A and 14B. The container also includes a remaining pair of opposing side walls that are formed in part by sealing flaps 16A and 16B. According to the present invention, at least one of the walls of the container includes the opening system of the present invention. In the examples shown, the container opening system 30, to open container 10, is located in sealing flap 16A. The opening system 30, however, may be located in other sides or surfaces of the container. Although container 10 is depicted as having a rectangular shape, in general, container 10 can have any shape and can be made from a variety of materials.

Figure 2:
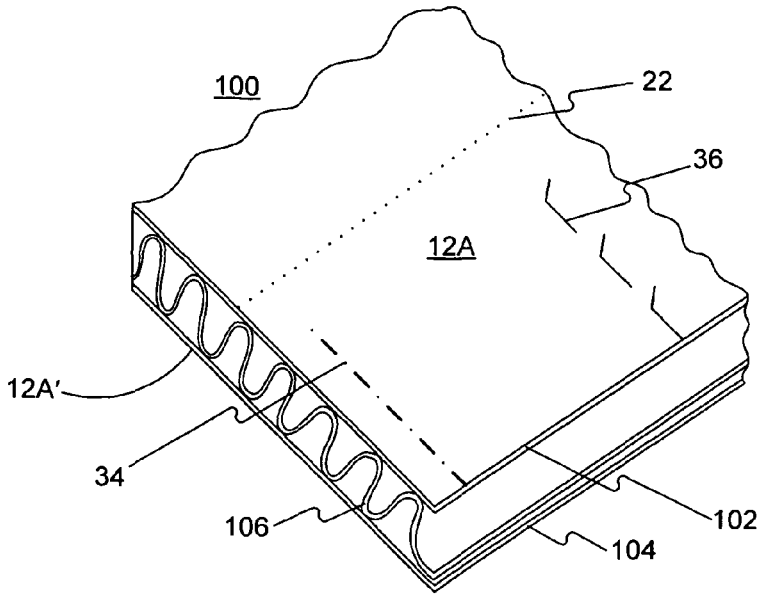
FIG. 2 is an illustration of a section of a corrugated fiberboard blank that may be used to construct the container of FIG. 1

FIG. 2 illustrates a section of a container blank 100 that may be used to construct container 10. Blank 100 may be constructed in a conventional manner with a corrugated medium 106 positioned between a first liner 102 and a second liner 104. The corrugated medium 106 may be adhered to the first and second liners 102 and 104 to orient the corrugations in a preferred direction between the first and second liners 102, 104. Selected locations of blank 100 may include one or more lines of weakness. These lines of weakness may assist in the construction of a three-dimensional container 10 from a flat blank 100, and enable the opening of container 10.

The lines of weakness may be regions of blank 100 where the strength of the blank in one or more directions is intentionally reduced so that the blank 100 may fold or tear along the line. Blank 100 may include many different types of lines of weakness consistent with the opening system disclosed herein. In some embodiments, such lines of weakness include a fold line 22 and first and second perforation lines 34 and 36. Fold line 22 may be a line along which the strength of the blank 100 is reduced so that the blank may fold along fold line 22 when a bending force is applied to the blank 100. As used herein, bending force merely refers to a force applied to the blank 100 that may bend blank 100 along fold line 22. Blank 100 may also include many different types of perforation lines. Perforation lines may include lines along which the strength of the blank is reduced so that the blank 100 may tear along this line when a tearing force is applied to blank 100. As used herein, tearing force merely refers to a force applied to blank 100 that may tear the blank along the perforation line. Among other types of forces, the tearing force may include pushing inwards, or pulling outwards, on the blank in the vicinity of a line of perforation. As explained more fully below, the perforation lines may be designed such that different levels of forces may be required to allow the blank to tear along a given line.

Among the many different types of lines of perforations that may be found on blank 100, are first and second perforation lines 34 and 36. First and second perforation lines 34 and 36 may have different levels of strength such that one of these perforation lines may be torn upon the application of one level of force and the other perforation line may be torn upon the application of a different level of force. For example, first perforation line 34 that may tear when a relatively low level of force is applied to blank 100 in the vicinity of the perforation line 34 while second perforation line 36 may tear when a higher level of force is applied to blank 100 in the vicinity of the line 36. Fold lines 22 and first and second perforation lines 34 and 36 may be constructed by conventional techniques. For instance, one or more of the corrugated medium 106, first liner 102, and second liner 104 may be pressed, bent, or slit along a line or in a pattern to reduce the strength of blank 100 along the line. Known industry techniques may be used to create these perforation lines.

Figure 3A:
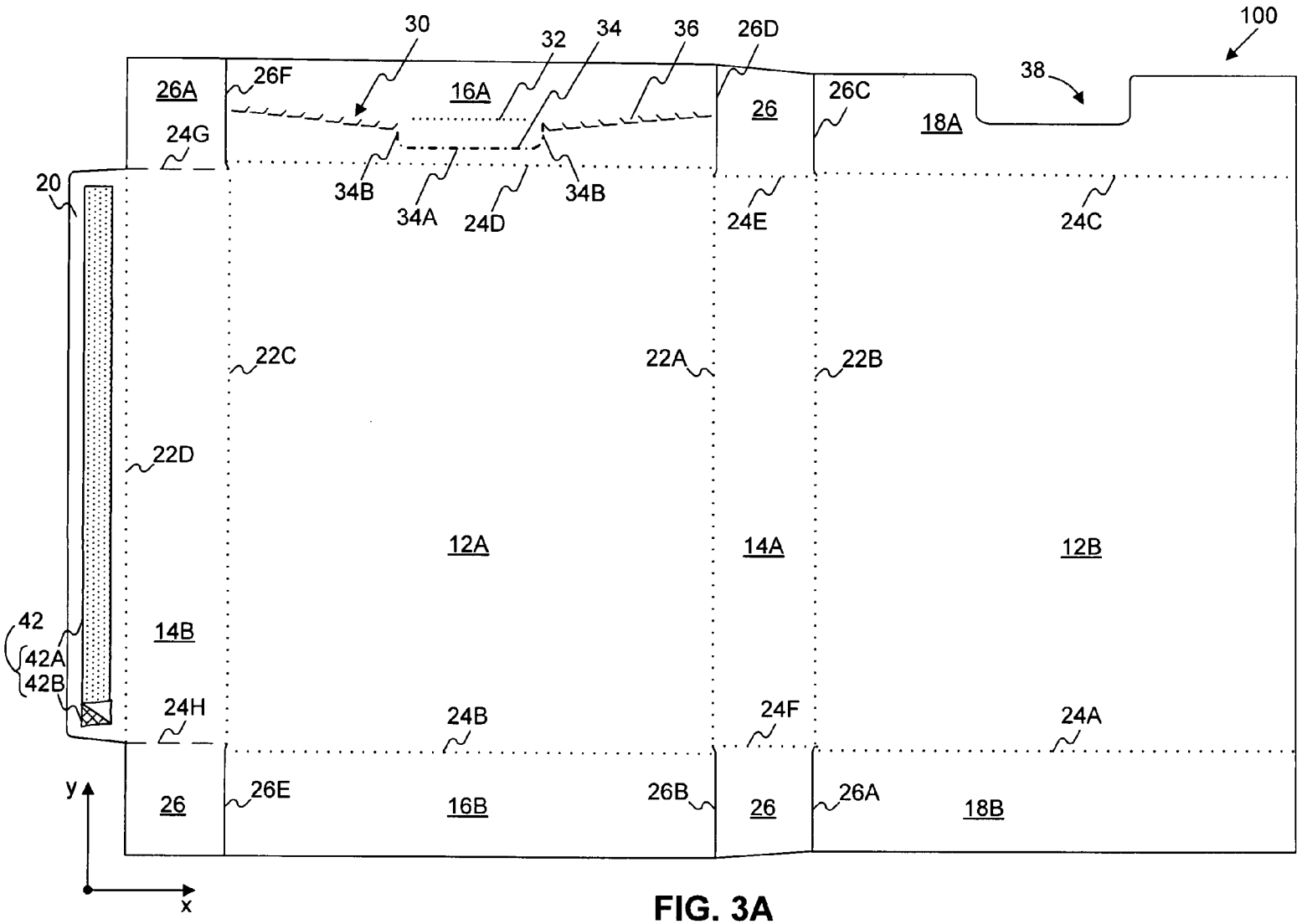
FIG. 3A is a plan view of the front side of one exemplary container blank that may be used to construct the container of FIG. 1.
Figure 3B:
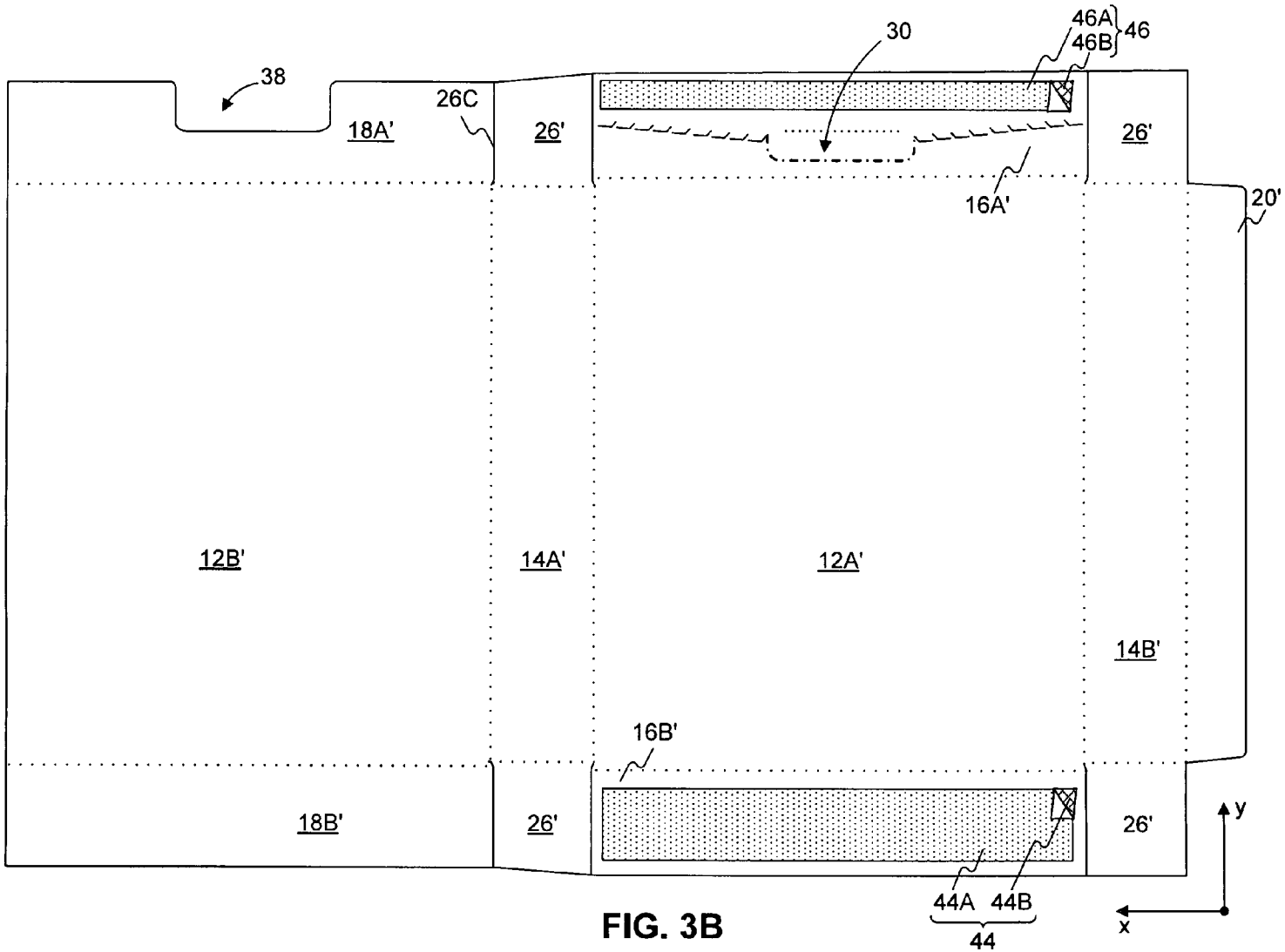
FIG. 3B is a plan view of the back side of the container blank of FIG. 2 that may be used to assemble the container of FIG. 1.

FIGS. 3A and 3B illustrate plan views of the outside and the inside surface, respectively, of container blank 100 that may used to construct container 10. It should be emphasized that the configuration of the blank illustrated in FIGS. 3A and 3B is exemplary only, and in general, container blank 100 may be configured in any manner that is suitable to construct a container of a desired size and shape. The outside surface of container blank 100 may form the external surface of container 10 after construction, and the inside surface of blank 100 may form the internal surface of container 10. In the discussion that follows, reference will be made to both FIGS. 3A and 3B. For ease of visualization and description, x and y axis labels are provided on FIGS. 3A and 3B, and the inside surface of a section of blank 100 identified in FIG. 3A is labeled in FIG. 3B with a "'" mark.

Container blank 100 may include multiple fold lines 22A-22D, and 24A-24H aligned in different directions. In the embodiment illustrated in FIGS. 3A and 3B, these fold lines include first fold lines 22A-22D aligned along the y-axis direction and second fold lines 24A-24H aligned along the x-axis direction. Container blank 100 may also include slits 26A-26F that separate sections of the blank that forms flaps 26. The different fold lines separate different sections of the container blank 100 that, after construction, form different sides of container 10. For instance, first fold lines 22A and 22C and second fold lines 24B and 24D may form between them a section of blank 100 that forms first face panel 12A of container 10. The outside surface of the first face panel is labeled 12A in FIG. 3A and the inside surface of the same section is labeled 12A' in FIG. 3B. Similarly, first fold line 22D may separate a section of blank 100 that forms side tab 20, which extends outwardly from a panel 14B. Fold lines 24B and 24D may separate sections of blank 100 that form sealing flaps 16A and 16B, and fold lines 24A and 24C may separate sections of blank 100 that form end flaps 18A and 18B.

The outside surface of side tab 20 may include a box glue joint 42, and the inside surfaces of sealing flaps 16A' and 16B' may include adhesive strips 44 and 46. Box glue joint 42 and adhesive strips 44 and 46 may include any type of adhesives or glues known in the art. In some embodiments, the box glue joint 42 may include a layer of adhesive attaching different sections of the blank together. In some embodiments, box glue joint 42 may also be an adhesive strip. These adhesive strips may include a layer of sticky material (42B, 44B, and 46B) covered with a layer of covering material (42A, 42B, and 42C). To attach different sections of the blank 100 to each other during construction, the covering material is removed and the desired sections of the blank 100 are attached together using the layer of sticky material. The section of the blank can also be attached together by other conventional ways, including gluing them together with an adhesive.

In the exemplary embodiment shown, sealing flap 16A and end flap 18A include features of the opening system of the present inventions that enable easy opening of container 10. These features include a slot 38 on end flap 18A and a perforation pattern 30 on sealing flap 16A. In the embodiment, slot 38 includes a region of material that is removed from blank 100. Although slot 38 is illustrated as having a rectangular shape positioned at the edge of end flap 18A, slot 38 can have any geometry and be positioned anywhere on end flap 18A. For instance, in some embodiments, slot 38 may be a rectangular or an oval area of missing material positioned centrally on end flap 18A. In some embodiments, slot 38 may be a die cut feature on blank 100. In embodiments where the opening system is positioned on a different side of container 10, slot 10 may be positioned on that side. It is also contemplated that some embodiments of opening system of the current invention do not include slot 38.

A perforation pattern 30 of the present invention may include a first perforation line 34 located adjacent to one or more second perforation lines 36. In the embodiment shown in FIG. 3A, the perforation pattern 30 is centrally positioned between two perforation lines 36. The first perforation line 34 may include a central section 34A that is aligned along the x axis and end sections 34B on either side of the central section 34A that are aligned along the y-axis, or are angled away from the x axis. Curved sections may connect the central section 34A to these two end sections 34B. The two second perforation lines 36 are proximate to the first perforation line 34 and may, for example, extend from the ends of the two end sections 34B of the first perforation line 34 to slits 26D and 26F positioned on either side of sealing flap 16A. More generally, one or more second perforation lines extend outwardly from a first perforation line 34 in a manner and degree that allows a portion of the container to be torn along these perforation lines 34 and 36 and thereby open the container so its contents can be removed.

In some embodiments, the two second perforation lines 36 may extend at an angle from the ends of the first perforation line 34 to the slits 26D and 27F. That is, the ends of the two second perforation lines 36 that terminate at slits 26D and 27F may be spaced apart along the y-axis from the ends of the first perforation line 34. The blank may also include a fold line 32 spaced apart from and aligned to the central section 34A of the first perforation line 34. In a preferred embodiment perforation line 34 is designed to tear in response to a lower level force than perforation lines 36, such that, when a tearing force is applied in the vicinity of the perforation pattern 30, the material of sealing flap 16A may tear along the first perforation line 34 first and then along the second perforation lines 36, when a greater force is applied.

Figure 4A:
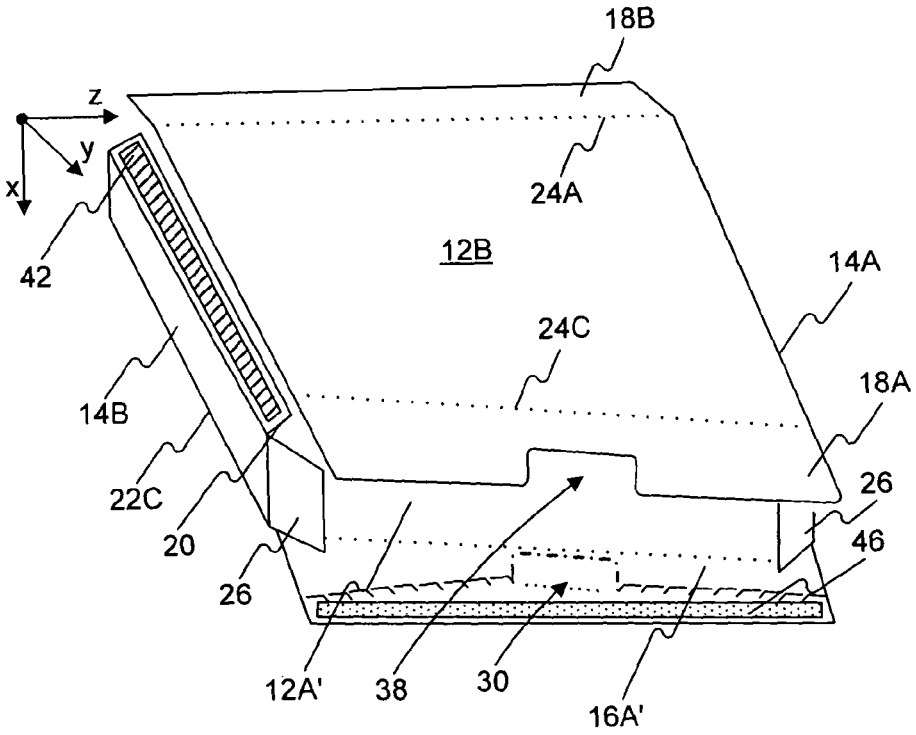
FIGS. 4A-4D are schematic illustrations showing the assembly of the exemplary container of FIG. 1.

FIGS. 4A-4D illustrate the construction of an exemplary container 10 from container blank 100. Container blank 100 may be folded along the different fold lines to form different sides of container 10. For instance, container blank 100 may be folded by about 90° along each of first fold lines 22A, 22B, 22C and 22D, as illustrated in FIG. 4A, to form four sides (the face panels 12A and 12B, and side walls 14A and 14B) of container 10. Folding container blank 100 along first fold line 22D forms end tab section 20 that may be tucked under second end panel 12B, such that the outside surface of end tab 20 with box glue joint 42 faces the inside surface of second end panel 12B'. In embodiments where the box glue joint 42 is an adhesive strip, the layer of covering material 42A may be removed and the underlying layer of sticky material 42B may be used to attach end tab 20 to the inside surface of the second end panel 12B'. In some embodiments, customers may receive container 10 with end tab 20 pre attached to the second end panel 12B' using box glue joint 42.

Figure 4B:
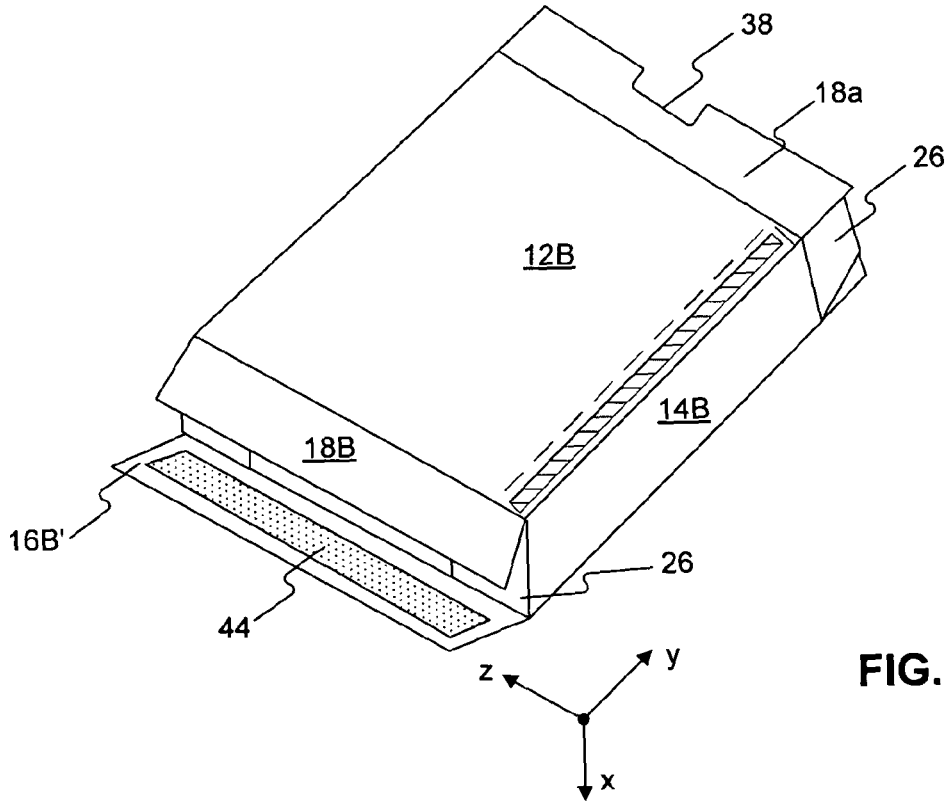
Figure 4C:
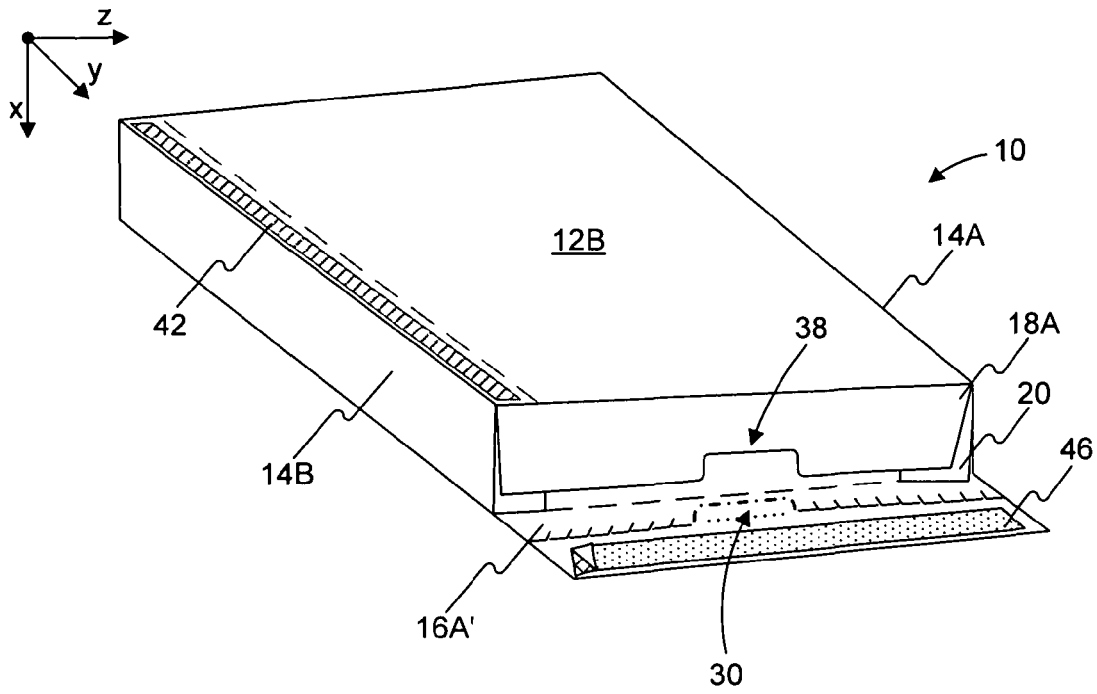
Figure 4D:
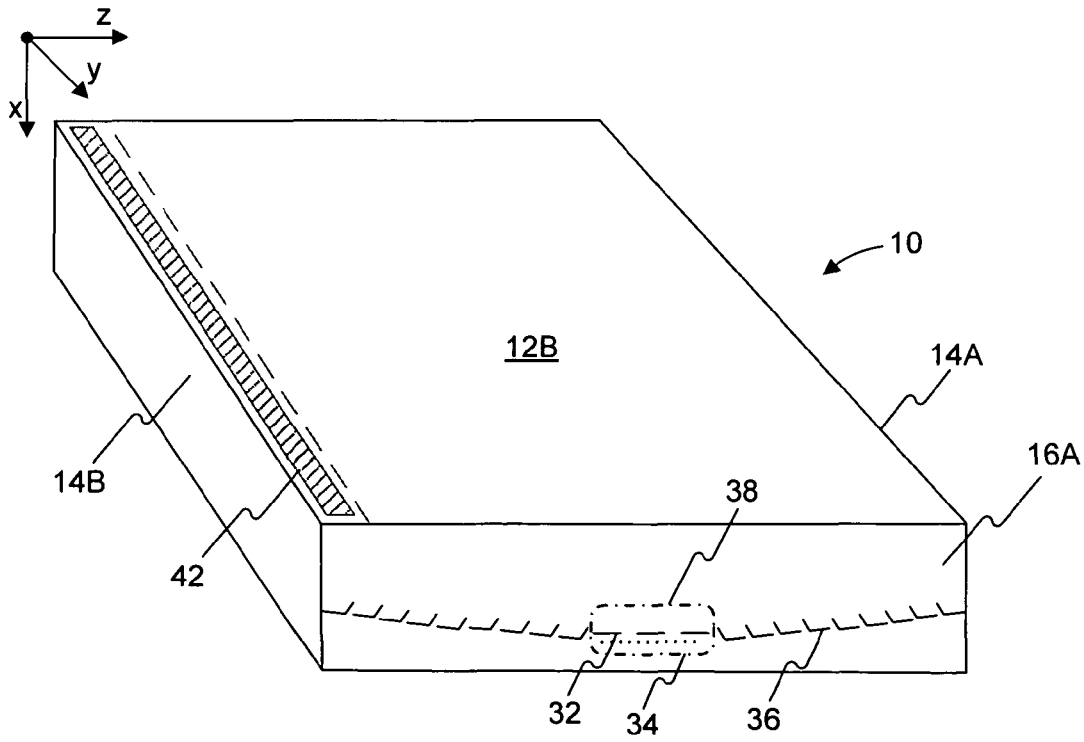

Flaps 26 attached to side walls 14A and 14B may be folded in, and end flap 18B may be folded over these flaps 26 as illustrated in FIG. 4B. Sealing flap 16B may now be folded over the folded end flap 18B, with adhesive strip 44 on the inside surface of sealing flap 16B' used to attach sealing flap 16B to end flap 18B. The folded sections of blank 100 now enclose a space within container 10, with the open end flap 18A and sealing flap 16A providing access to this enclosed space. An article to be shipped may be placed in the enclosed space, and the flaps 26 attached to side walls 14A and 14B may be folded in towards the enclosed space. End flap 18A with slot 38 may now be folded over these folded flaps 26. Sealing flap 16A with the perforation pattern 30 may then be folded over the folded end flap 18A. Adhesive strip 46 on the inside surface of sealing flap 16A' is used to attach sealing flap 16B to end flap 18B to form a closed container 10, as illustrated in FIG. 4D.

Figure 4E:
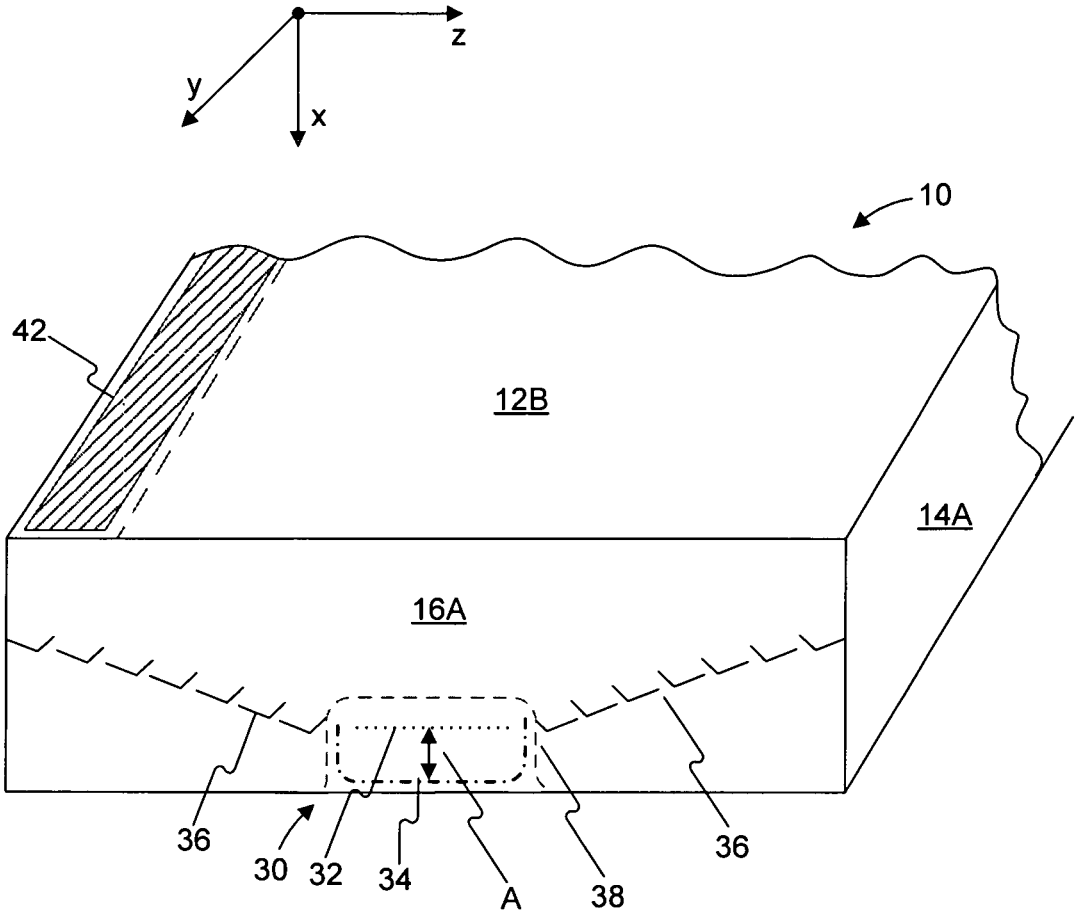
FIG. 4E is an enlarged view of the side of an assembled container with the opening system.

FIG. 4E illustrates an enlarged view of the side of the assembled container 10 with an exemplary embodiment of the opening system of the present invention. In the assembled configuration, perforation pattern 30 on sealing flap 16A overlies slot 38 on end flap 18A. In this exemplary embodiment, a region A of sealing flap 16A between first perforation line 34 and fold line 32 of perforation pattern 30 overlies slot 38 and is smaller than the slot, so that the region A may extend into the open area formed by the slot 38, or some other open area found in inner flap 18A. This overlying region A of sealing flap 16A over slot 28 is thus unsupported by end flap 18A behind it.

It should be emphasized that the sequence of operations to assemble container 10 that are described herein is exemplary only, and that a variety of sequences of operations to make containers may be followed. In general, the sequence of operations may depend upon the size, shape, and material of the container.

Figure 5A:
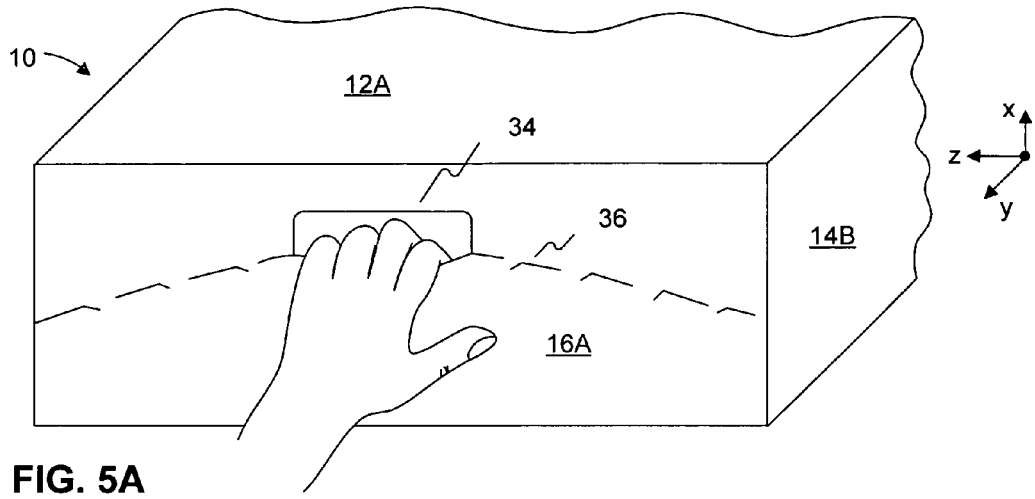
FIG. 5A-5C are schematic illustrations showing the opening of the exemplary container of FIG. 1 using the opening system.
Figure 5B:
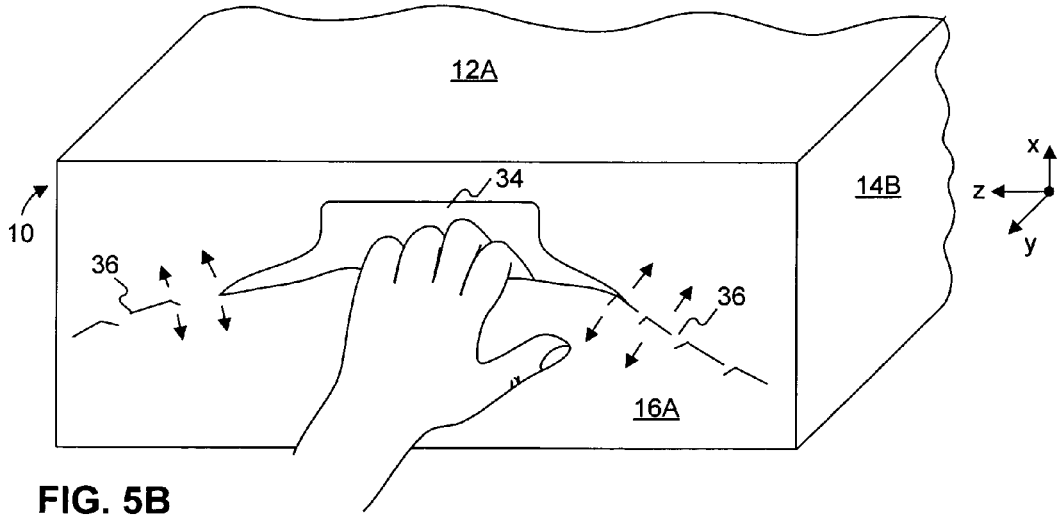
Figure 5C:
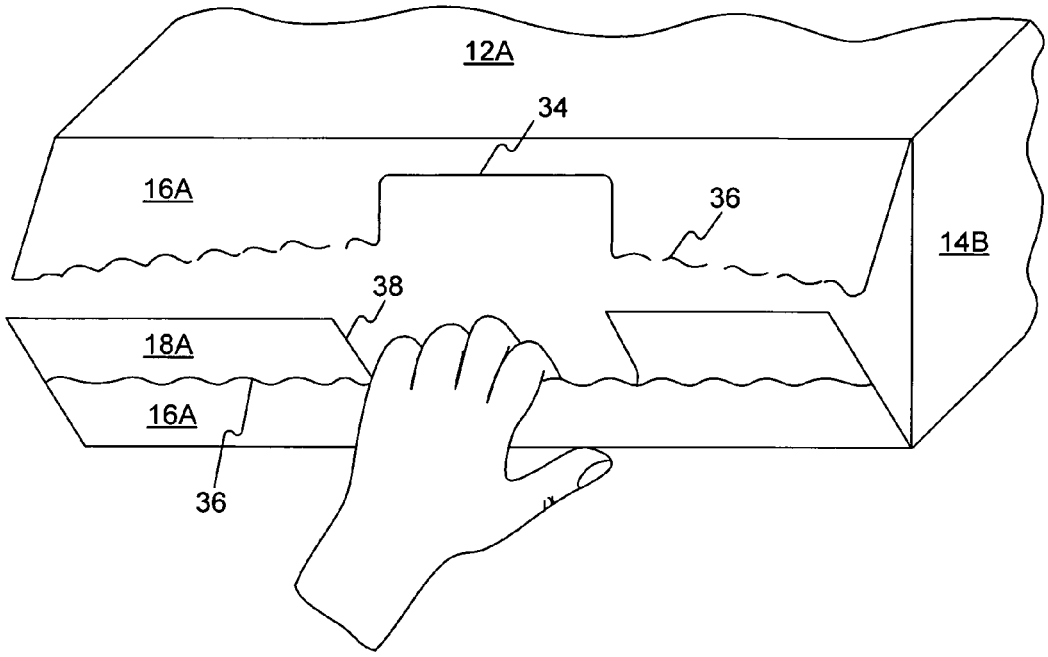

FIGS. 5A-5C illustrate the opening of a container 10 that includes the embodiment of the opening system 30 depicted in FIG. 4E. To open container 10, a user may press on sealing flap 16A in the vicinity of the unsupported region A. This pressing action by the user may apply a tearing force on the first perforation line 34. As a result, first perforation line 34 may separate along a path defined by the line. Tearing along the first perforation line 34 separates a section of sealing flap 16A which is connected to the remaining sections of sealing flap 16A at fold line 32. This separated section of the sealing flap 16A includes a region overlying slot 38 on end flap 18A. Upon further pressing by the user, the separated section of sealing flap 16A may fold into container 10 at fold line 32, allowing the user's fingers to enter the enclosed space of container 10 and hook on the inside surface of end flap 18A' (FIG. 5A). This in effect provides the user an opening or handle area that the user can readily grip and then apply an outward pulling force on the flap.

Using the fingers resting on the inside surface of end flap 18A', the user can now pull on end flap 18A towards the outside of container 10. This pulling action pulls end flap 18A and the overlying sealing flap 16A towards the outside of container 10, thereby applying a tearing force on the second perforation line(s) 36, in this case two perforation lines 36. This tearing force tends to initiate a tear on the ends of the two second perforation lines proximate the user's fingers (FIG. 5B). Upon further pulling action by the user, this tear may travel along the length of the two second perforation lines 36, causing a section of sealing flap 16A to separate and provide access to the enclosed space within container 10. In some embodiments, sections of the sealing flap may tear off the container, while in other embodiments, a region of sealing flap (such as a region of sealing flap 16A adhered to end flap 18A using adhesive strip 46) may remain attached after the perforation lines separate. The entire end of the container is therefore open, just as it was when material were inserted into the container. In the embodiment of opening system 30 disclosed herein, no portion may be torn away from the container, thus reducing litter that needs to be picked up after opening the container.

Although a particular method and sequence of operations to open container 10 is illustrated in FIGS. 5A-5C, other methods and order of operations are also possible. By means of example only, the size, location, and shape of perforation lines can take a variety of different forms. The pull region formed by the first perforation lines can take a different shape, and in some instances, only one second perforation line will be needed, or would be acceptable.

Figure 6:
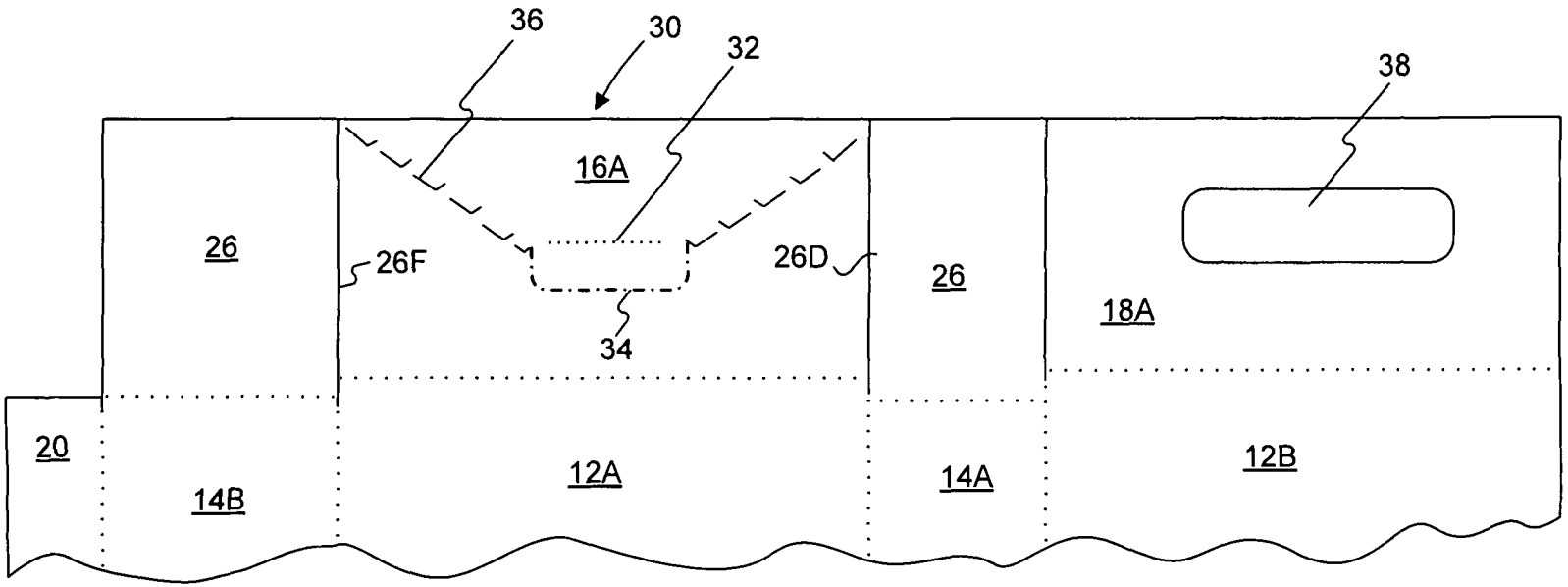
FIG. 6 is illustrates another embodiment of an opening system of the invention that may be used with the container of FIG. 1.

In some embodiments, slot 38 and perforation pattern 30 may be configured differently. For instance, as illustrated in FIG. 6, slot 38 may be a rectangular (or other shaped) opening on end section 18A, and the two second perforation lines 36 may extend from the end of first perforation line 34 to the corner of slits 26F and 26D. In some embodiments, each of the two second perforation lines 36 may have different shapes, or may include different sections that extend in different directions. The embodiment of container 10 and opening system described in this disclosure are configured to enable one or more of a user's fingers to pierce through the side of container 10 and pull open the container. However, other configurations are possible. For instance, in some embodiments, the shape of slot 28 and the arrangement of perforation lines on the overlying sealing flap may be suited for a machine or a tool to perform or assist in the task of opening. In these embodiments, the features of the opening system may be sized and oriented to allow the machine or tool to open container 10.

We claim:

1. An opening system for a container, comprising:

an end flap for extending over an opening of the container, the end flap including an open area defined therein; and a sealing flap overlying the end flap and attached to the end flap at an attachment region extending along an edge of the sealing flap, the sealing flap including a perforation pattern, the perforation pattern including, a first perforation line including a central section extending over the open area, a second perforation line extending from a first end of the first perforation line, towards the attachment region, to a first edge of the sealing flap, wherein the first perforation line and the second perforation line have different patterns such that the first perforation line is configured to tear at a lower force than the second perforation line.

2. The opening system of claim 1, further including a third perforation line extending from a second end of the first perforation line, towards the attachment region, to a second edge of the sealing flap opposite the first edge, wherein the third perforation line and the first perforation line have different patterns such that the third perforation line is configured to tear at a higher force than the first perforation line.

3. The opening system of claim 2, further including a fold line spaced apart from the central section of the first perforation line such that an area of the sealing flap between the central section and the fold line is positioned over the open area of the end flap.

4. The opening system of claim 3, wherein the area of the sealing flap between the central section and the fold line is sized to accommodate one or more fingers of a user to rest on the area.

5. The opening system of claim 3, wherein the first, second, and the third perforation lines are configured to tear and separate a portion of the sealing flap including the attachment region to open the container.

6. The opening system of claim 2, wherein the sealing flap and the end flap each have the first edge opposite the second edge and a third edge opposite a fourth edge.

7. The opening system of claim 6, wherein the end flap is integral with one face panel of the container at the third edge of the end flap and the sealing flap is integral with an opposite face panel of the container at a third edge of the sealing flap, wherein the attachment region attaches a length of the sealing flap proximate the fourth edge of the sealing flap to a length of the end flap proximate the third edge of the end flap.

8. The opening system of claim 6, wherein the first perforation line is positioned between the third edge of the sealing flap and the second and third perforation lines.

9. The opening system of claim 7, wherein an underside of the sealing flap proximate the fourth edge includes an adhesive strip for adhering the sealing flap to the end flap.

10. The opening system of claim 7, wherein the fold line is positioned between the central section of the first perforation line and the fourth edge of the sealing flap.

11. The opening system of claim 7, wherein the open area of the end flap is centrally positioned between the first and second edges of the end flap.

12. The opening system of claim 11, wherein the open area extends to the fourth edge of the end flap.

13. The opening system of claim 11, wherein the open area has a substantially rectangular shape.

14. The opening system of claim 11, wherein the open area has a substantially trapezoidal shape.

15. A method of opening a container having a sealing flap that is integral with one face panel of the container overlaid on an end flap that is integral with an opposite face panel of the container and adhered to the sealing flap at one edge, the end flap including an open area defined therein and the sealing flap including a perforation pattern having a first perforation line and a second perforation line extending from the first perforation line to a first edge of the sealing flap, the first perforation line and the second perforation line having different patterns such that the first perforation line is configured to tear at a lower force than the second perforation line, the first perforation line including a central section that extends over the open area of the end flap, the sealing flap also including a fold line spaced apart from the central section, comprising:

pressing inwards on an area of a sealing flap between the central section of the first perforation line and the fold line to tear a region of the sealing flap at the first perforation line;

folding the torn region of the sealing flap at the fold line over an underside of the end flap proximate the open area; and pulling outwards on the underside of the end flap to tear the second perforation line and open a side of the container.

16. The method of claim 15, wherein the sealing flap further includes a third perforation line, which is configured to tear at a higher force than the first perforation line, extending from the first perforation line to a second edge of the sealing flap opposite the first edge, wherein pulling outwards on the underside of the end flap tears both the second and third perforation lines.

17. The method of claim 15, wherein pressing inwards on the area includes pressing the area using one or more fingers of a user.

18. The method of claim 17, wherein pressing inwards on the area includes one or more fingers of the user piercing through the area of the sealing flap and the open area of the end flap.

19. The method of claim 17, wherein folding the torn region of the sealing flap includes one or more fingers of the user extending into the container through the open area of the end flap and resting on the underside of the end flap.

20. The method of claim 17, wherein pulling outwards on the underside of the end flap includes one or more fingers of the user exerting a force on the underside of the end flap to pull the end flap outwards from the container.

21. The method of claim 20, wherein pulling outwards on the underside of the end flap further includes the end flap pushing against an underside of the sealing flap to apply a force on the sealing flap in a direction outwards from the container.

22. A container, comprising:

a first face panel spaced apart from a second face panel, the two face panels being interconnected by side walls to define a space between the two face panels;

an end flap integral with the first face panel and configured to be folded towards the second face panel to at least partially cover a gap between the two face panels, the end flap including an open area defined therein; and a sealing flap integral with the second face panel and configured to be folded over and attached to the end flap at an attachment region when the end flap is folded, the attachment region being a region that extends along an edge of the sealing flap, the sealing flap including a perforation pattern, the perforation pattern including, a first perforation line extending at least partially over the open area of the end flap, a second perforation line extending from the first perforation line, towards the attachment region, to a first edge of the sealing flap, wherein the first perforation line and the second perforation line have different patterns such that the second perforation line is configured to tear at a higher force than the first perforation line, and a fold line spaced apart from a central section of the first perforation line such that an area of the sealing flap between the central section and the fold line is positioned over the open area of the end flap.

23. The container of claim 22, wherein the area of the sealing flap between the central section and the fold line is sized to accommodate one or more fingers a user to rest on the area.

24. The container of claim 22, wherein the sealing flap and the end flap each have the first edge opposite a second edge and a third edge opposite a fourth edge, the end flap being integral with the first face panel at the third edge of the end flap and the sealing flap being integral with the second face panel at the third edge of the sealing flap, and wherein the attachment region attaches a region of the sealing flap proximate the fourth edge of the sealing flap to a region of the end flap proximate the third edge of the end flap.

25. The container of claim 24, wherein the sealing flap further includes a third perforation line extending from the first perforation line, towards the attachment region, to the second edge of the sealing flap.

26. The container of claim 24, wherein the first perforation line is positioned between the third edge of the sealing flap and the second and third perforation lines.

27. The container of claim 24, wherein the fold line is positioned between the central section of the first perforation line and the fourth edge.

28. The container of claim 24, wherein the open area of the end flap extends to the fourth edge of the end flap.

29. The container of claim 24, wherein the open area of the end flap has a substantially rectangular shape.

30. The container of claim 24, wherein the open area of the end flap has a substantially trapezoidal shape.

* * * * *

UNITED STATES PATENT AND TRADEMARK OFFICE

CERTIFICATE OF CORRECTION

PATENT NO. : 8,459,538 B2
APPLICATION NO. : 12/654105
DATED : June 11, 2013
INVENTOR(S) : Erika J. Raeth, Kenneth Vilag and Thomas J. Wood It is certified that error appears in the above-identified patent and that said Letters Patent is hereby corrected as shown below:

In the Claims

Claim 23, col. 10, line 15, "one or more fingers a user," should read as -- one or more fingers of a user --.

Signed and Sealed this
Twenty-third Day of July, 2013

Teresa Stanek Rea
*Acting Director of the United States Patent and Trademark Office*